US010016000B2

(12) United States Patent
Cheung

(10) Patent No.: US 10,016,000 B2
(45) Date of Patent: Jul. 10, 2018

(54) BRASSIERE STEEL RING HAVING AN IRREGULAR CROSS SECTION

(71) Applicant: KAIPING HUNGHON GARMENT ACCESSORIES CO., LTD, Guangdong (CN)

(72) Inventor: Suilung Cheung, Guangdong (CN)

(73) Assignee: KAIPING HUNGHON GARMENT ACCESSORIES CO., LTD, Guangdong (CN)

( * ) Notice: Subject to any disclaimer, the term of this patent is extended or adjusted under 35 U.S.C. 154(b) by 57 days.

(21) Appl. No.: 15/153,062

(22) Filed: May 12, 2016

(65) Prior Publication Data

US 2016/0255882 A1 Sep. 8, 2016

Related U.S. Application Data

(63) Continuation of application No. PCT/CN2014/094806, filed on Dec. 24, 2014.

(30) Foreign Application Priority Data

Nov. 13, 2013 (CN) ..... 2013 1 0567773

(51) Int. Cl.
*A41C 3/12* (2006.01)

(52) U.S. Cl.
CPC ..... *A41C 3/122* (2013.01); *A41C 3/128* (2013.01)

(58) Field of Classification Search
CPC .... A41C 1/00; A41C 1/12; A41C 1/14; A41C 1/16; A41C 1/18; A41C 3/12; A41C 3/122; A41C 3/128; A41C 3/124; A41C 3/00
USPC ..... 450/41, 45, 4, 47, 48, 51, 52
See application file for complete search history.

(56) References Cited

U.S. PATENT DOCUMENTS 2,438,062 A * 3/1948 Licht ..... A41C 3/08 450/30
3,562,802 A * 2/1971 Avis ..... A41C 3/122 2/260.1
5,730,640 A * 3/1998 Acx ..... A41C 3/122 2/255

(Continued)

FOREIGN PATENT DOCUMENTS

CN 1140980 A 1/1997
CN 103549668 A 2/2014
CN 203523823 U 4/2014

(Continued)

*Primary Examiner* — Gloria Hale
(74) *Attorney, Agent, or Firm* — Muncy, Geissler, Olds & Lowe, P.C.

(57) ABSTRACT

A brassiere steel ring having an irregular cross section that is comfortable to wear and has a long life is provided. The steel ring has an overall arc shape comprising an arc-shaped inner edge and an arc-shaped outer edge. A reduced neck section is provided in the middle part of the cross section of the steel ring. The reduced neck section divides the cross section of the steel ring into a upper section and a lower section, and has a width smaller than those of the upper section and the lower section. The upper section forms the arc-shaped inner edge of the steel ring, and the lower section forms the arc-shaped outer edge of the steel ring. By this way, the anti-fatigue ability of the steel ring will not be decreased when its cross section is enlarged, which increases the life of the steel ring.

14 Claims, 4 Drawing Sheets

(56) References Cited

U.S. PATENT DOCUMENTS

| | | | | |
|---|---|---|---|---|
| 6,241,576 | B1 * | 6/2001 | Hofer | A41C 3/122<br>450/41 |
| 2009/0017724 | A1 | 1/2009 | Gill | |

FOREIGN PATENT DOCUMENTS

| | | | |
|---|---|---|---|
| EP | 1028638 | A1 | 8/2000 |
| FR | 1194481 | A | 11/1959 |
| FR | 2140798 | A5 | 1/1973 |
| WO | WO 9518553 | A1 | 7/1995 |
| WO | WO 99/22613 | A1 | 5/1999 |
| WO | WO 2006/059068 | A1 | 6/2006 |

* cited by examiner

BRASSIERE STEEL RING HAVING AN IRREGULAR CROSS SECTION

FIELD OF THE INVENTION

The present invention is related to the field of female clothing accessories for supporting breasts, such as brassiere, underwear or swimwear, etc., and more particularly, to a brassiere steel ring having an irregular cross section.

BACKGROUND OF THE INVENTION

Common brassiere steel rings are usually made of metal materials and have two types of cross section, i.e., round and flat. Given a certain material property and overall shape of a steel ring, its force resistance property and anti-fatigue ability are determined. Therefore, many designers focus their directions mainly on the shape and material of the steel ring. However, they have not made significant improvements to the shape of the cross section of the steel ring.

It has been verified by scientific experiments that a steel ring made of a steel wire having a round cross section has relatively high anti-fatigue ability when being stretched or compressed. However, due to its round cross section, the forces applied on it are isotropic, i.e., the forces from all directions have no difference, while when being worn, the forces applied on the steel ring, mainly the stretching force and the compressing force, are asymmetric. Therefore, a steel ring having a round cross section results in either a waste in materials or an insufficiently applied force in the stretching direction or compressing direction.

Therefore, a steel ring having a flat cross section, i.e., a steel ring formed by pressing a steel wire into a flat shape is mostly used in prior art. Although a steel ring having a flat cross section has smaller longitudinal resistance, i.e., smaller supporting strength compared to a steel ring having a round cross section, and therefore is easy to deform, it provides another advantage, i.e., more comfortable wearing experience. However, on the other hand, it has poor anti-fatigue ability and therefore has a short life.

Many improvements to the shape of the steel ring have been developed in prior art. However, none of them can solve this problem: on one hand, a steel ring that is easy to be stretched is thus easy to be bent inwardly and deformed, resulting in a short life; on the other hand, a steel ring that is hard to be stretched is thus hard to be bent inwardly, resulting in a long time to fit to a user's body and making the user feel uncomfortable for a long time.

Therefore it is a common practice in the art to improve the life of a steel ring by enlarging the area of its cross section. However, the inventor of the present application found by fatigue resistance experiments that given a specific design of the cross section, the steel ring's fatigue resistance will start to decrease when the area of the cross section increases to a certain value. After analysis, the inventor found that this is due to interactions between molecules in the inner and outer edges of the steel ring when a force is applying on it. This interaction increases as the area of its cross section increases, and is easy to make the overall steel ring to reach its fatigue limit. Therefore, it is wrong to just simply increase the area of the cross section of a steel ring, which is a bias in the prior art that no one else have ever found.

SUMMARY OF THE INVENTION

An object of the present invention is to overcome one of the above deficiencies in the art and provide a brassiere steel ring having an irregular cross section that is comfortable to wear and has a long life.

This and other objects and advantages of the present invention are achieved by the solutions described herein after.

A brassiere steel ring having an irregular cross section is provided. The steel ring has an overall arc shape comprising an arc-shaped inner edge and an arc-shaped outer edge. According to the present invention, a reduced neck section is provided in the middle part of the cross section of the steel ring. The reduced neck section divides the cross-section of the steel ring into a upper section and a lower section, and has a width smaller than those of the upper section and the lower section. The upper section forms the arc-shaped inner edge and the lower section forms the arc-shaped outer edge.

When the steel ring according to the present invention is being stretched or compressed, its reduced neck section forms a buffer area, isolating the interactions between the inner edge and the outer edge, thereby the anti-fatigue ability of the steel ring will not be decreased when its cross section is enlarged, so as to improve the life of the steel ring.

To provide a more comfortable wearing experience, the upper section and the lower section both have smooth arc shapes, the reduced neck section has an inwardly extending arc shape, and the reduced neck section extends smoothly with the upper section and the lower section. Smooth extending of the reduced neck section together with the upper section and the lower section facilitates to prevent focus of stresses and to uniformly distribute stresses, avoiding to form a weak portion when applying a force.

In order to further improve its anti-fatigue ability, the cross section of the steel ring has a longitudinal symmetry axis extending longitudinally along the lower section, the reduced neck section and the upper section, and the cross section of the steel ring is longitudinally axisymmetric with respect to said longitudinal symmetry axis. Since the steel ring is either to be stretched or compressed when applying a force on it, it is the best to be longitudinally axisymmetric. This cross section can eliminate the influence of the non-uniformly applied forces of the inner and outer edges of the steel ring on its anti-fatigue ability.

In one of the preferable embodiments, the cross section of the steel ring has a horizontal symmetry axis extending horizontally along the middle part of the reduced neck section, and the cross section of the steel ring is horizontally axisymmetric with respect to said horizontal symmetry axis. The two vertically positioned symmetric axes allows the anti-fatigue abilities in the inner and outer edges of the steel ring to be equivalent, and allows the anti-stretching ability and anti-compressing ability of the steel ring to be equivalent, providing a simple design that is easy to produce.

Specifically, the cross section of the steel ring has a waisted round shape having an arc-shaped reduced neck section, or a peanut shape. According to a large number of experiments, tests and feedbacks of users, a preferable size of the cross section of the steel ring is as follows: the cross section of the steel ring has a longitudinal height of 1.6-2.4 mm, the upper section and the lower section are symmetric and both have horizontal widths of 0.6-1.0 mm, the reduced neck section has a horizontal width of 0.4-0.6 mm, and the horizontal width of the reduced neck section is smaller than those of the upper section and the lower section. This scope of size is suitable for most of users, and can be adapted to steel rings of different cross sections, and thus can be used for common brassieres.

In order to improve wearing experience of a brassiere or underwear, the lower section of the cross section of the steel ring has a horizontal width larger than a horizontal width of the upper section, i.e., thickness of the outer edge of the steel ring is larger than thickness of the inner edge of the steel ring. By this way, asymmetric force resistance abilities are provided in the inner edge and outer edge of the steel ring, providing the steel ring with the following properties: being hard to be stretched, which is advantageous to keep the shape of the steel ring and makes it hard to be deformed; being easy to be bent inwardly, which is advantageous to fit to a human body. This relatively complex structure can significantly improve wearing experience of the user, and provide more comfort and a good shaping effect. It will bring no discomfort even in a vigorous exercise.

After testing, preferably the horizontal width of the lower section is 1.2-3 times the horizontal width of the upper section. This asymmetric arrangement takes full consideration of the material, the discomfort caused by difference in the dimensions of the upper section and the lower section, and the force resistance abilities of the inner edge and the outer edge, making the steel ring comfortable to wear, and providing ergonomical stretching and compressing resistance abilities and a low cost.

Specifically, the cross section of the steel ring has a bowling ball shape having an arc-shaped reduced neck section, or a pear shape, or a cucurbit shape. According to a large number of experiments, tests and feedbacks of users, a preferable size of the cross section of the steel ring is as follows: the cross section of the steel ring has a longitudinal height of 2.0-3.2 mm, the upper section has a horizontal width of 0.3-0.8 mm, the lower section has a horizontal width of 0.8-1.5 mm, the reduced neck section has a horizontal width of 0.15-0.5 mm, the horizontal width of the reduced neck section is respectively smaller than those of the upper section and the lower section, and a ratio between the horizontal widths of the lower section and the upper section is not more than 3. It can be seen that this scope of size is slightly increased compared to that of the above symmetric structure, which leads to an increase in its stretching and compressing resistance abilities, while bringing no increase in its dimension, which means that their costs for materials are basically the same. This is due to the fact that the size of the steel ring is reasonably adjusted according to its force resistance property. Compared to a symmetric structure, the above structure is more comfortable and provides a shaping effect.

In conclusion, the inventor of the present application found a bias in prior art which blindly enlarges the cross section of a steel ring, and found another way to make a design according to structural characteristics of the cross section of the steel ring. The present invention greatly improves anti-fatigue ability of the steel ring and extends the life of the steel ring by buffering the interactions between the inner and outer edges of the arc shape through a reduced neck section. The present invention further makes the steel ring more comfortable and lowers the cost by a reasonable design of the cross section. In particular, the asymmetric structure makes the steel ring more ergonomical, more comfortable, and provides a shaping effect with no increase in the cost of materials. Therefore, the brassiere steel ring having an irregular cross section provided by the present application has substantive features and represents notable progress compared to prior art.

BRIEF DESCRIPTION TO THE DRAWINGS

DETAILED DESCRIPTION OF THE INVENTION

The present invention will be described in conjugation with embodiments and figures. It is understood that those embodiments are provided as examples only, and not limiting the scope of the present invention. To provide a better description of the embodiments, some parts in the figures is omitted, enlarged, or shrunk, and they don't represent actual size of the product. It is understood to a skilled person in the art that some common structures in the figures and their descriptions may be omitted.

Example 1

Figure 1:
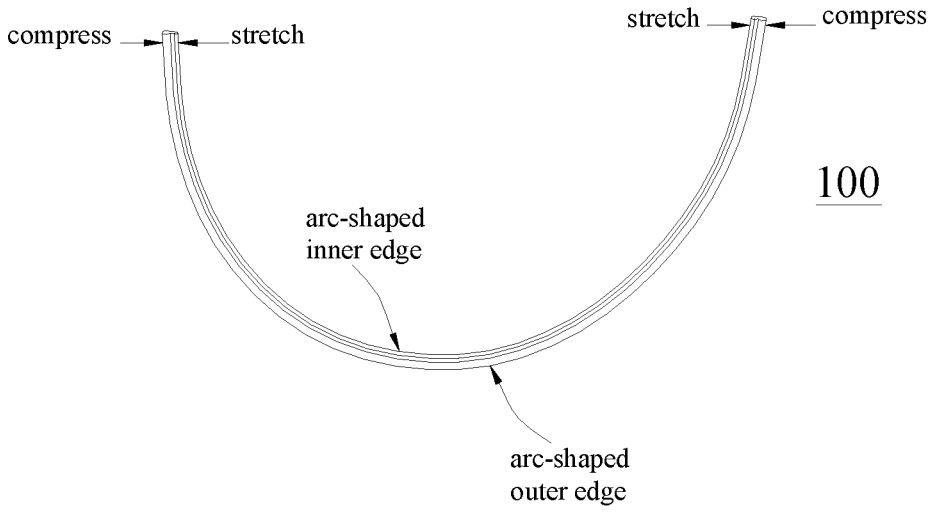
FIG. 1 shows a schematic view of the structure of a steel ring according to one example of the present invention.

FIG. 1 shows a brassiere steel ring having an irregular cross section 100. The steel ring 100 has an overall arc shape comprising an arc-shaped inner edge and an arc-shaped outer edge as indicated in the figure. During wearing of the brassiere, the steel ring 100 has applied thereon mainly two forces, i.e., a stretching force and a compressing force, of directions as indicated by the arrows in the figure.

Figure 2:
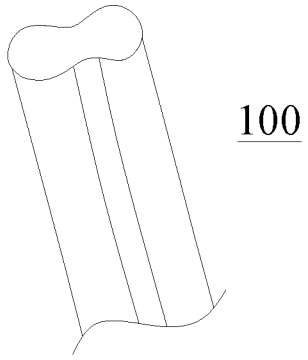
FIG. 2 shows an enlarged view of the cross section of part of the steel ring according to Example 1 of the present invention.
Figure 3:
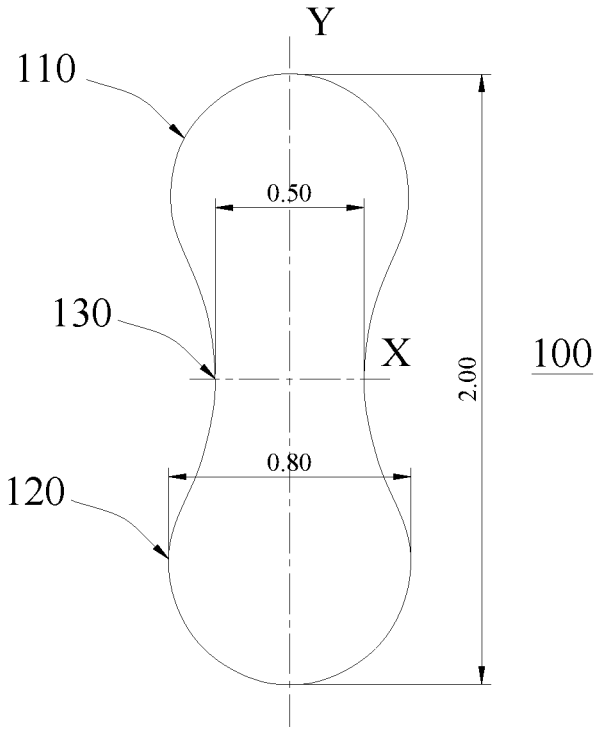
FIG. 3 shows a sized view of the cross section of the steel ring according to Example 1 of the present invention.

It can be seen from FIGS. 2 and 3 that a reduced neck section 130 is provided in the middle part of the cross section of the steel ring 100. The reduced neck section 130 divides the cross-section of the steel ring into a upper section 110 and a lower section 120, and has a width smaller than the upper section and the lower section. The upper section 110 forms the arc-shaped inner edge of the steel ring 100, and the lower section 120 forms the arc-shaped outer edge of the steel ring 100.

The upper section 110 and the lower section 120 both have smooth arc-shaped profiles. The reduced neck section 130 has an inwardly extending arc shape, and the reduced neck section 130 extends smoothly with the upper section 110 and the lower section 120.

The cross section of the steel ring 100 has a longitudinal symmetry axis Y extending longitudinally along the lower section 120, the reduced neck section 130 and the upper section 110, and a horizontal symmetry axis X extending horizontally along the middle part of the reduced neck section 130. The cross section of the steel ring 100 is symmetric with respect to said horizontal symmetry axis X and said longitudinal symmetry axis Y. To be specific, the cross section of the steel ring 100 has a waisted round shape having an arc-shaped reduced neck section 130, which is like the shape of a peanut.

FIG. 3 shows the size details of the cross section of the steel ring 100. Its cross section has a longitudinal height of 2.00 mm, the upper section 110 and the lower section 120 are symmetric and both have horizontal widths of 0.80 mm, and the reduced neck section 130 has a horizontal width of 0.50 mm.

When the steel ring 100 is being stretched or compressed, the reduced neck section 130 can form a buffer area, isolating the interactions between the inner edge (i.e., the upper section 110) and the outer edge (i.e., the lower section 120), thereby the anti-fatigue ability of the steel ring 100 will not be decreased when its cross section is enlarged, so as to increase the life of the steel ring 100. The structure with two vertically positioned symmetric axes allows the anti-fatigue abilities in the inner and outer edges of the steel ring 100 to be equivalent, and allows the anti-stretching ability and anti-compressing ability of the steel ring 100 to be equivalent, providing a simple design that is easy to produce.

Example 2

Figure 4:
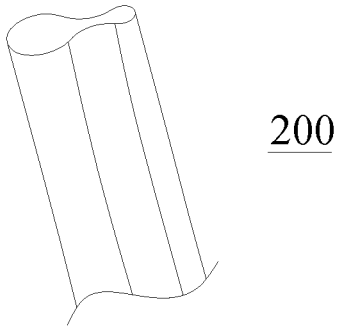
FIG. 4 shows an enlarged view of the cross section of part of the steel ring according to Example 2 of the present invention.

Overall structure of the present example is basically the same as the previous example, and thus need not be repeated here. It can be seen from FIGS. 4 and 5 that the lower section 220 of the cross section of the steel ring 200 has a horizontal width larger than a horizontal width of the upper section 210. Similarly, a reduced neck section 230 is provided in the middle part of the cross section of the steel ring 200. The reduced neck section 230 divides the cross-section of the steel ring into a upper section 210 and a lower section 220, and has a width smaller than those of the upper section and the lower section. The upper section 210 forms the arc-shaped inner edge of the steel ring 200, and the lower section 220 forms the arc-shaped outer edge of the steel ring 200.

The upper section 210 and the lower section 220 also both have a smooth arc shapes. The reduced neck section 230 has an inwardly extending arc shape, and the reduced neck section 230 extends smoothly with the upper section 210 and the lower section 220.

The cross section of the steel ring 200 has a longitudinal symmetry axis Y extending longitudinally along the lower section 220, the reduced neck section 230 and the upper section 210, and the cross section of the steel ring 200 is longitudinally axisymmetric with respect to said longitudinal symmetry axis Y. To be specific, the cross section of the steel ring 200 has a bowling pin shape having an arc-shaped reduced neck section 220, or a pear shape or a cucurbit shape.

Figure 5:
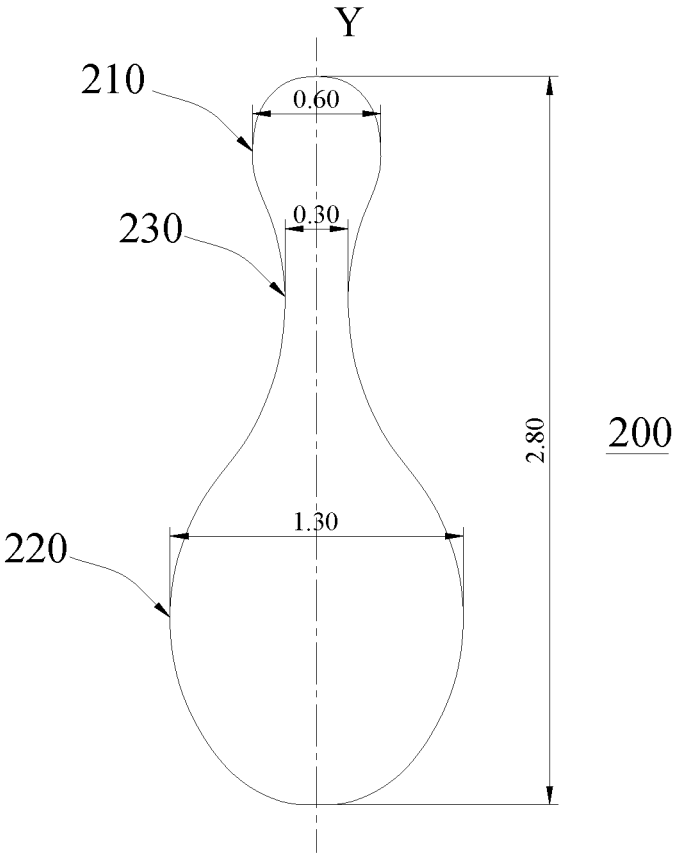
FIG. 5 shows a sized view of the cross section of the steel ring according to Example 2 of the present invention.

Thickness of the outer edge of the steel ring is larger than thickness of the inner edge of the steel ring. FIG. 5 shows the size of the cross section of the steel ring 200. Its cross section has a longitudinal height of 2.80 mm, the upper section 210 has a horizontal width of 0.60 mm, the lower section 220 has a horizontal width of 1.30 mm, and the reduced neck section 230 has a horizontal width of 0.30 mm.

It can be seen that this scope of size is slightly increased compared to that of the previous example, which leads to an increase in its stretching and compressing resistance abilities, while bringing no increase in its dimension, which means that their costs for materials are basically the same. This is due to the fact that the size of the steel ring 200 is reasonably adjusted according to its force resistance property. Compared to a symmetric structure with the same cost in materials, the above structure is more comfortable and provides a shaping effect.

In other examples that are based on this structure, the cross section has a longitudinal height of 2.0, 2.5, 3.0 or 3.2 mm, the upper section 210 has a horizontal width of 0.3, 0.4, 0.6 or 0.8 mm, the lower section 220 has a horizontal width of 0.8, 1.0, 1.3 or 1.5 mm, and the reduced neck section has a horizontal width of 0.15, 0.25, 0.30 or 0.5 mm.

Example 3

Figure 6:
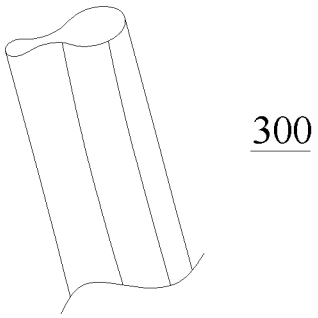
FIG. 6 shows an enlarged view of the cross section of part of the steel ring according to Example 3 of the present invention.

The present example is a preferable example with an overall structure basically the same as the previous example, and thus need not be repeated here. It can be seen from FIGS. 6 and 7 that the lower section 320 of the cross section of the steel ring 300 has a horizontal width smaller than a horizontal width of the upper section 310. Similarly, a reduced neck section 330 is provided in the middle part of the cross section of the steel ring 300. The reduced neck section 330 divides the cross-section of the steel ring into a upper section 310 and a lower section 320, and has a width smaller than the upper section and the lower section. The upper section 310 forms the arc-shaped inner edge of the steel ring 300, and the lower section 320 forms the arc-shaped outer edge of the steel ring 300.

The upper section 310 and the lower section 320 also have smooth arc shapes. The reduced neck section 330 has an inwardly extending arc shape, and the reduced neck section 330 extends smoothly with the upper section 310 and the lower section 320.

The cross section of the steel ring 300 has a longitudinal symmetry axis Y extending longitudinally along the lower section 320, the reduced neck section 330 and the upper section 310, and the cross section of the steel ring 300 is longitudinally axisymmetric with respect to said longitudinal symmetry axis Y. To be specific, the cross section of the steel ring 300 has a bowling pin shape having an arc-shaped reduced neck section 320, or a pear shape or a cucurbit shape.

Figure 7:
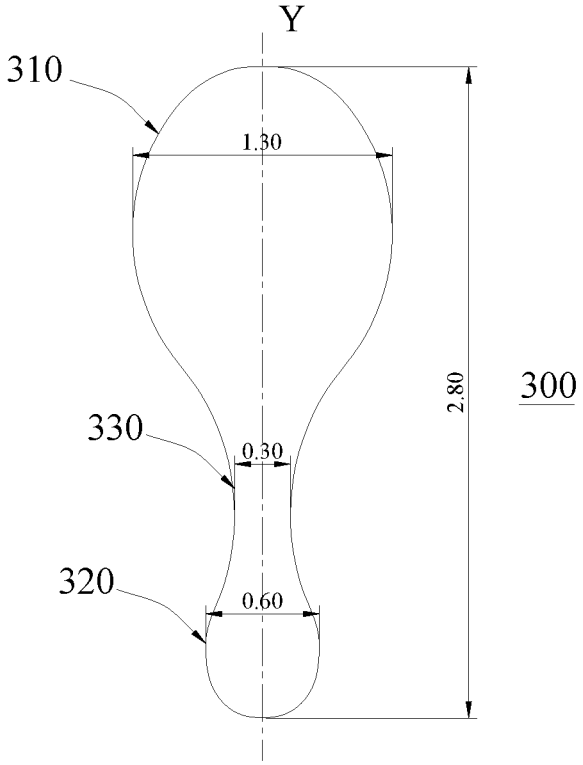
FIG. 7 shows a sized view of the cross section of the steel ring according to Example 3 of the present invention.

Thickness of the outer edge of the steel ring is smaller than thickness of the inner edge of the steel ring. FIG. 7 shows the size of the cross section of the steel ring 300. Its cross section has a longitudinal height of 2.80 mm, the upper section 310 has a horizontal width of 1.30 mm, the lower section 220 has a horizontal width of 0.60 mm, and the reduced neck section 330 has a horizontal width of 0.30 mm.

In other preferable examples, the cross section has a longitudinal height of 2.0, 2.5, 3.0 or 3.2 mm, the upper section 310 has a horizontal width of 0.8, 1.0, 1.3 or 1.5 mm, the lower section 320 has a horizontal width of 0.3, 0.4, 0.6 or 0.8 mm, and the reduced neck section 330 has a horizontal width of 0.15, 0.25, 0.30 or 0.5 mm.

Under conditions with the same parameters (including distance between two ends of the steel ring, and material), comparative fatigue tests were performed with the same stretching or compressing force and speed to the steel rings of Examples 2 and 3. It can be seen from the comparative tests that the anti-compressing abilities in Examples 2 and 3 have little difference, but with regard to their anti-stretching ability, Example 3 is obviously better than Example 2. Example 3 has an anti-stretching ability 2-4 times Example 2.

It should be understood that position relationships in the figures are used for exemplary descriptions only, and should not be interpreted as limitations to the present invention. Obviously, the above examples are provided for clear explanations of the present invention, and not for limiting to the embodiments of the present invention. To a skilled person in the art, changes or alterations can be made based on the above descriptions. It is not necessary or possible to exhaustively give examples of all the embodiments. All alterations, equivalent replacements and improvements within the spirit and principle of the present invention, should be included in the scope of the claims of the present application.

The invention claimed is:

1. A brassiere steel ring having an irregular cross section, the steel ring comprising: an overall arc shape, the overall arc shape comprises an arc-shaped inner edge and an arc-shaped outer edge, wherein a reduced neck section is provided in a middle part of a cross section of the steel ring, the reduced neck section dividing the cross-section of the steel ring into a upper section and a lower section, and having a width smaller than those of the upper section and the lower section, wherein the upper section forms the arc-shaped inner edge and the lower section forms the arc-shaped outer edge, and wherein the reduced neck section forms a buffer area when the brassiere steel ring is stretched or compressed thereby isolating the interactions between the arc-shaped inner edge and the arc-shaped outer edge.

2. The brassiere steel ring of claim 1, wherein the upper section and the lower section have smooth arc shapes, the reduced neck section has an inwardly extending arc shape, and the reduced neck section extends smoothly with the upper section and the lower section.

3. The brassiere steel ring of claim 2, wherein the cross section of the steel ring has a longitudinal symmetry axis extending longitudinally along the lower section, the reduced neck section and the upper section, and the cross section of the steel ring is longitudinally axisymmetric with respect to said longitudinal symmetry axis.

4. The brassiere steel ring of claim 3, wherein the cross section of the steel ring has a horizontal symmetry axis extending horizontally along a middle part of the reduced neck section, and the cross section of the steel ring is horizontally axisymmetric with respect to said horizontal symmetry axis.

5. The brassiere steel ring of claim 4, wherein the cross section of the steel ring has a waisted round shape having an arc-shaped reduced neck section.

6. The brassiere steel ring of claim 1, wherein the cross section of the steel ring has a longitudinal height of 1.6-2.4 mm, the upper section and the lower section are symmetric and have horizontal widths of 0.6-1.0 mm, the reduced neck section has a horizontal width of 0.4-0.6 mm, and the horizontal width of the reduced neck section is smaller than those of the upper section and the lower section.

7. The brassiere steel ring of claim 3, wherein the lower section of the cross section of the steel ring has a horizontal width larger than a horizontal width of the upper section.

8. The brassiere steel ring of claim 7, wherein the horizontal width of the lower section of the cross section of the steel ring is 1.2-3 times the horizontal width of the upper section.

9. The brassiere steel ring of claim 7, wherein the cross section of the steel ring has a bowling pin shape having an arc-shaped reduced neck section.

10. The brassiere steel ring of claim 7, wherein the cross section of the steel ring has a longitudinal height of 2.0-3.2 mm, the upper section has a horizontal width of 0.3-0.8 mm, the lower section has a horizontal width of 0.8-1.5 mm, the reduced neck section has a horizontal width of 0.15-0.5 mm, the horizontal width of the reduced neck section is respectively smaller than those of the upper section and the lower section, and a ratio between the horizontal widths of the lower section and the upper section is not more than 3.

11. The brassiere steel ring of claim 3, wherein the lower section of the cross section of the steel ring has a horizontal width smaller than a horizontal width of the upper section.

12. The brassiere steel ring of claim 11, wherein the horizontal width of the upper section of the cross section of the steel ring is 1.2-3 times the horizontal width of the lower section.

13. The brassiere steel ring of claim 11, wherein the cross section of the steel ring has an inverted bowling pin shape having an arc-shaped reduced neck section.

14. The brassiere steel ring of claim 11, wherein the cross section of the steel ring has a longitudinal height of 2.0-3.2 mm, the upper section has a horizontal width of 0.8-1.5 mm, the lower section has a horizontal width of 0.3-0.8 mm, the reduced neck section has a horizontal width of 0.15-0.5 mm, the horizontal width of the reduced neck section is respectively smaller than those of the upper section and the lower section, and a ratio between the horizontal widths of the upper section and the lower section is not more than 3.

* * * * *